US008166692B2

(12) United States Patent
Fitzpatrick et al.

(10) Patent No.: US 8,166,692 B2
(45) **Date of Patent: *May 1, 2012**

(54) SELF-LEVELING FOLLOWER FOR AN AMMUNITION MAGAZINE

(75) Inventors: Richard M. Fitzpatrick, Longmont, CO (US); Michael T. Mayberry, Denver, CO (US); Brian L. Nakayama, Arvada, CO (US); Eric S. Nakayama, Broomfield, CO (US)

(73) Assignee: Magpul Industries Corp., Boulder, CO (US)

( * ) Notice: Subject to any disclaimer, the term of this patent is extended or adjusted under 35 U.S.C. 154(b) by 148 days.

This patent is subject to a terminal disclaimer.

(21) Appl. No.: 12/772,983

(22) Filed: May 3, 2010

(65) Prior Publication Data

US 2011/0113663 A1 May 19, 2011

Related U.S. Application Data

(63) Continuation-in-part of application No. 11/307,495, filed on Feb. 9, 2006, now Pat. No. 7,621,063, and a continuation-in-part of application No. 29/329,454, filed on Dec. 15, 2008, now Pat. No. 7,615,143, which is a continuation-in-part of application No. 11/307,495, filed on Feb. 9, 2006, now Pat. No. 7,621,063.

(51) Int. Cl.
*F41A 9/65* (2006.01)

(52) U.S. Cl. ..... 42/50

(58) Field of Classification Search ..... 42/49.01, 42/49.02, 50; D22/108
See application file for complete search history.

(56) References Cited

U.S. PATENT DOCUMENTS

| | | | | |
|---|---|---|---|---|
| 7,621,063 | B2 * | 11/2009 | Fitzpatrick et al. | 42/50 |
| 2009/0107022 | A1 * | 4/2009 | Fitzpatrick et al. | 42/50 |
| 2011/0113663 | A1 * | 5/2011 | Nakayama et al. | 42/50 |

* cited by examiner

*Primary Examiner* — Bret Hayes
(74) *Attorney, Agent, or Firm* — Geoffrey E. Dobbin

(57) ABSTRACT

The present invention is a self-leveling follower for an ammunition magazine. Side extensions provide greater stability to the follower and aid in its self-leveling feature. The follower according to the present invention is also manufactured to facilitate removal from and insertion into the magazine casing when maintaining the magazine. Additional features provide greater utility by improving bolt-stop capacity and consistency of ammunition feed.

18 Claims, 6 Drawing Sheets

SELF-LEVELING FOLLOWER FOR AN AMMUNITION MAGAZINE

CROSS-REFERENCES TO RELATED APPLICATIONS

This application claims priority under 35 USC §120 as a continuation-in-part application of prior filed U.S. non-provisional application Ser. No. 11/307,495, filed Feb. 6, 2006 as a perfection of prior provisional application 60/595,779, filed on Aug. 4, 2005, now U.S. Pat. No. 7,621,063 issued Nov. 24, 2009 and on U.S. design application 29/329,454, filed Dec. 15, 2008, which also claims priority as a continuation-in-part of non-provisional application Ser. No. 11/307,495. Both Applications are incorporated by reference herein in their entirety.

FIELD OF INVENTION

The present invention relates to the field of ammunition magazines and more particularly relates to an anti-tilt follower for said magazines.

BACKGROUND OF THE INVENTION

Followers are well known in the prior art and are regularly used in dispensing systems for uniform items. One such system is an ammunition magazine, whereby ammunition cartridges are individually dispensed from the magazine into the chamber of a firearm. Magazine and follower systems in the prior art have always had a possibility of jamming when in use because of the rapidity of fire and the very shape of larger capacity magazines, which tend to curve slightly. While traveling upwards and expelling ammunition cartridges, the follower may slip out of alignment with the magazine casing and the cartridges, jamming the magazine and prohibiting shooting with the magazine until re-aligned. The present invention, however, is a follower that is self-leveling, greatly reducing the need to correct misalignment. In this respect, the follower according to the present invention departs substantially from the usual designs in the prior art. Since the follower is self-leveling, it lacks some of the give necessary for consistent force distribution, especially for the last two rounds of a magazine. This variation in force distribution may cause a misfeed of the second-to-last fired round. As such, additional features are built into the magazine to even the force distribution and reduce the probability of misfeed.

SUMMARY OF THE INVENTION

In view of the foregoing disadvantages inherent in the known types of magazine follower systems, this invention provides an improved self-leveling follower. As such, the present invention's general purpose is to provide a new and improved follower that will level itself in relation to ammunition and the magazine casing without action on the part of the user. The design will also help prevent such misalignment from even occurring and features an easier mechanism for insertion and removal of the follower from the magazine for maintenance.

The main feature of the self-leveling follower is a radical extension of front and rear tangs below the level of the follower floor. Simultaneously, the tangs are shaped to fit channels formed in the magazine casing wall. The increased length of the tangs inhibits slippage and encourages self-leveling in the event slippage occurs. Grooves in the floor of the follower are fashioned in conformity with the shape of the magazine opening. This shaping allows for easier insertion and removal of the follower.

In order to compensate for misfeed, one feature that may be added to the follower is a slope built into its floor. Another is that the spacer is specially designed at its rear to require greater force from the bolt to cause misfeed. The rear of the follower may optionally be raised to facilitate bolt lock back systems.

The more important features of the invention have thus been outlined in order that the more detailed description that follows may be better understood and in order that the present contribution to the art may better be appreciated. Additional features of the invention will be described hereinafter and will form the subject matter of the claims that follow.

Many objects of this invention will appear from the following description and appended claims, reference being made to the accompanying drawings forming a part of this specification wherein like reference characters designate corresponding parts in the several views.

Before explaining at least one embodiment of the invention in detail, it is to be understood that the invention is not limited in its application to the details of construction and the arrangements of the components set forth in the following description or illustrated in the drawings. The invention is capable of other embodiments and of being practiced and carried out in various ways. Also it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION OF THE PREFERRED EMBODIMENT

With reference now to the drawings, the preferred embodiment of the self-leveling follower is herein described. It should be noted that the articles "a", "an" and "the", as used in this specification, include plural referents unless the content clearly dictates otherwise.

Figure 1:
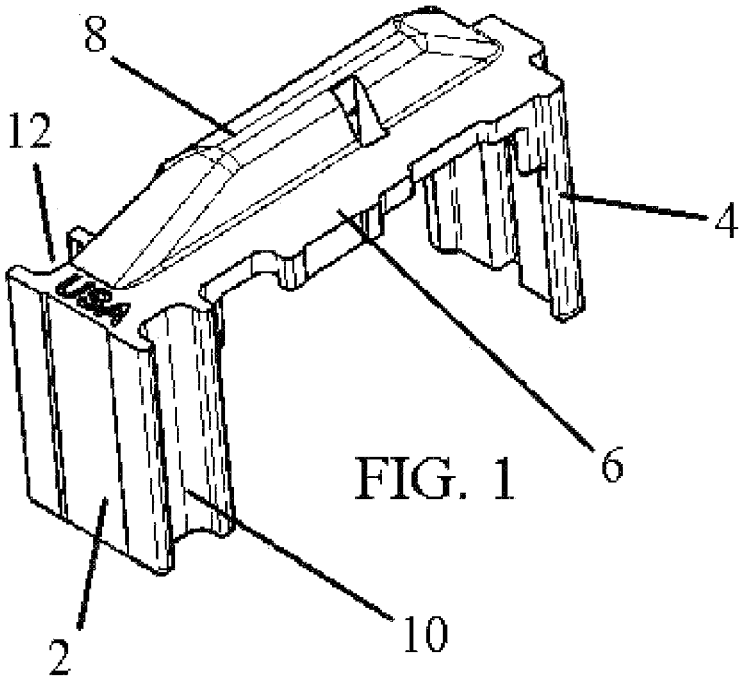
FIG. 1 is a top perspective view of a follower manufactured according to one embodiment the present invention.
Figure 3:
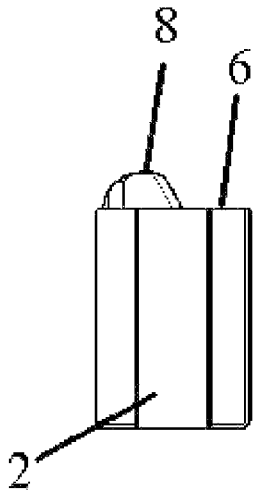
FIG. 3 is a front plan view of the follower of FIG. 1.
Figure 2:
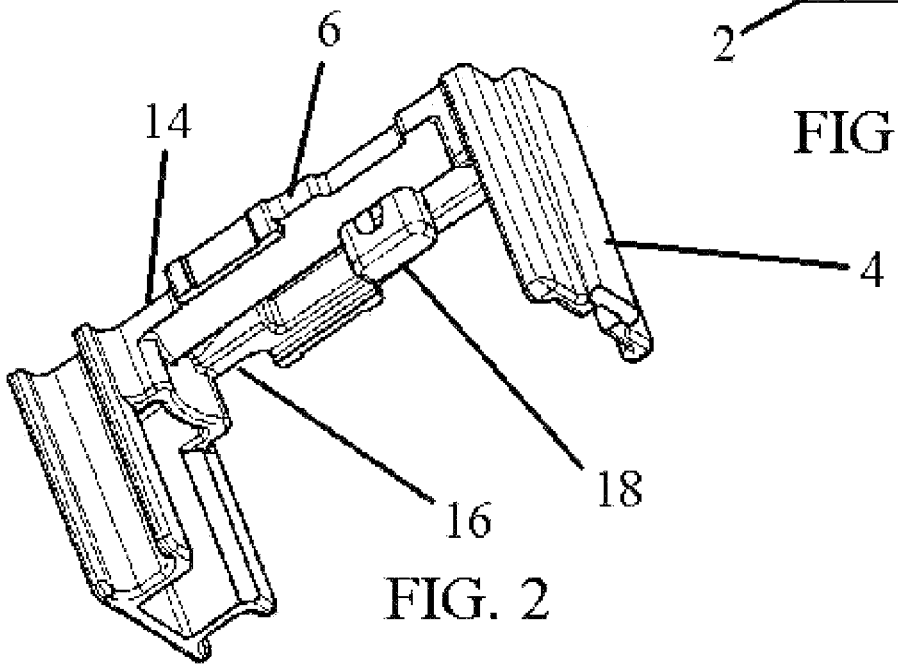
FIG. 2 is a bottom perspective view of the follower of FIG. 1.

The follower according to the present invention is similar in basic respects to prior art followers. As shown in FIGS. 1 and 2, the main body of the follower comprises a floor 6 with a spacer 8 on its upper side and a spring nub 18 on its bottom. The spring nub 18 interfaces with a follower spring (not shown) in the magazine while the spacer 8 elevates one set of cartridges in the magazine in relation to the other, allowing for a more efficient stacking of the ammunition.

Figure 5:
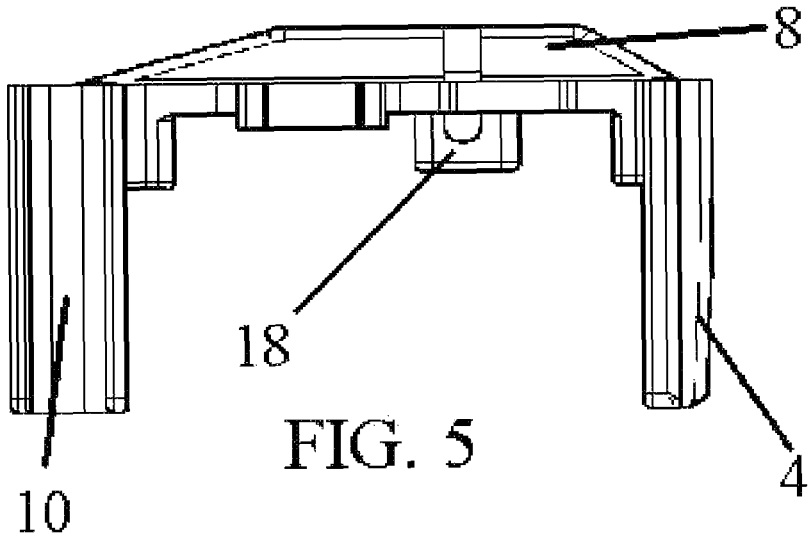
FIG. 5 is a left plan view of the follower of FIG. 1.
Figure 6:
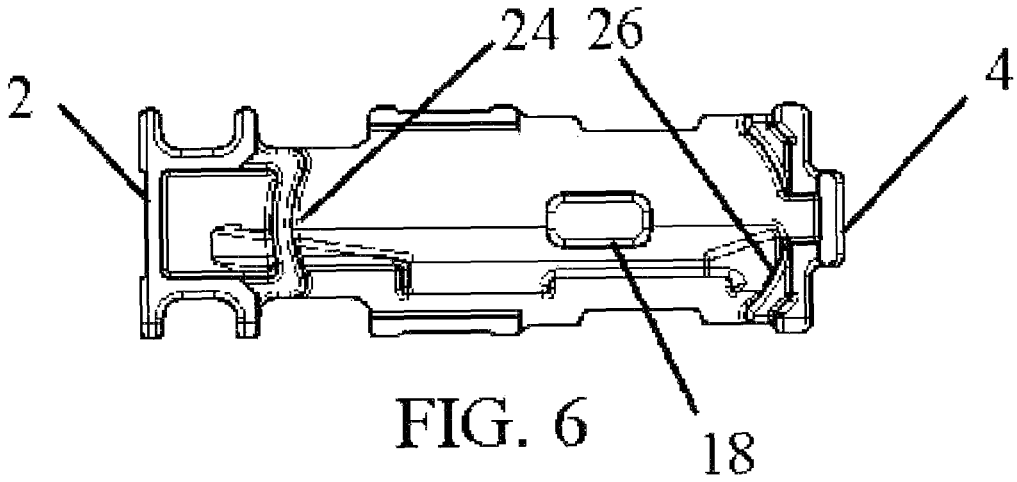
FIG. 6 is a bottom plan view of the follower of FIG. 1.
Figure 7:
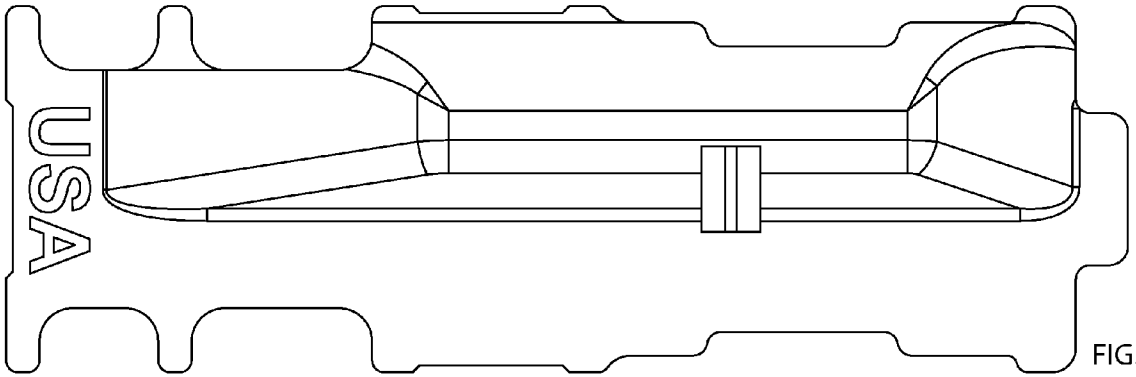
FIG. 7 is a larger scale top plan view of the follower of FIG. 1.
Figure 8:
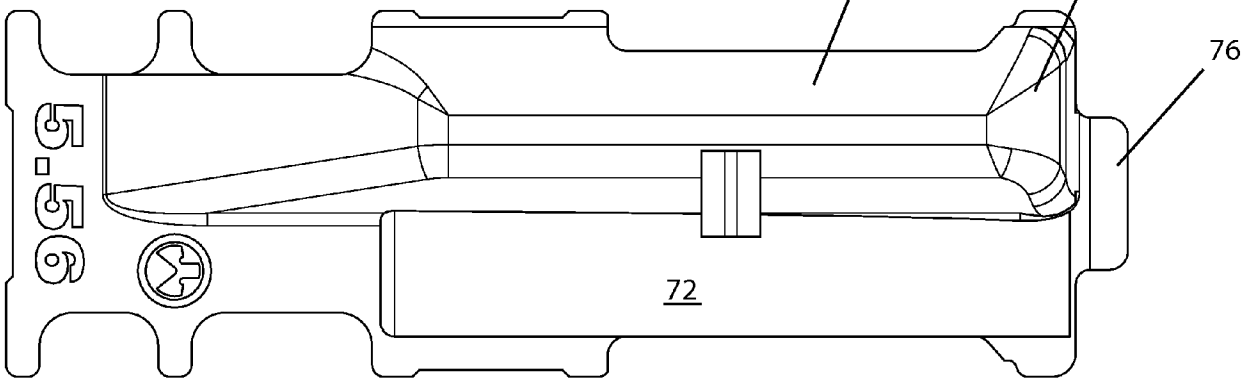
FIG. 8 is a top plan view of a second follower manufactured according to another embodiment of the invention, in the same scale as FIG. 7.
Figure 9:
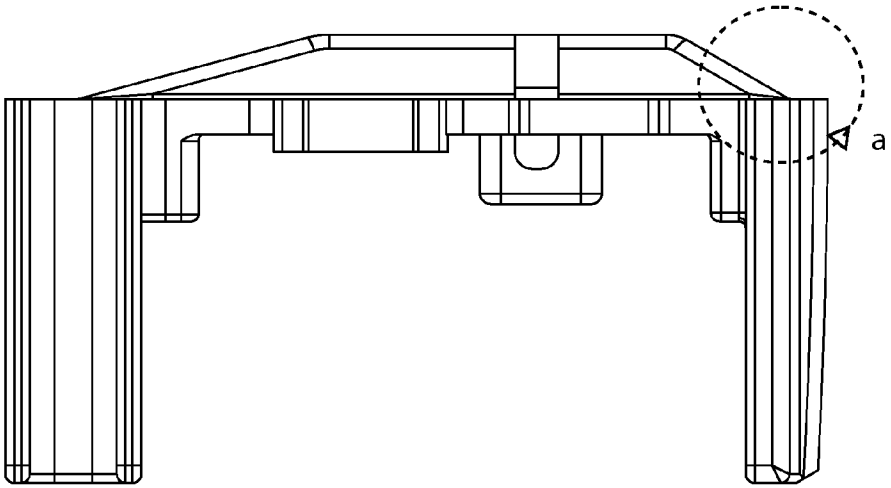
FIG. 9 is a perspective view of the follower of FIG. 7.
Figure 10:
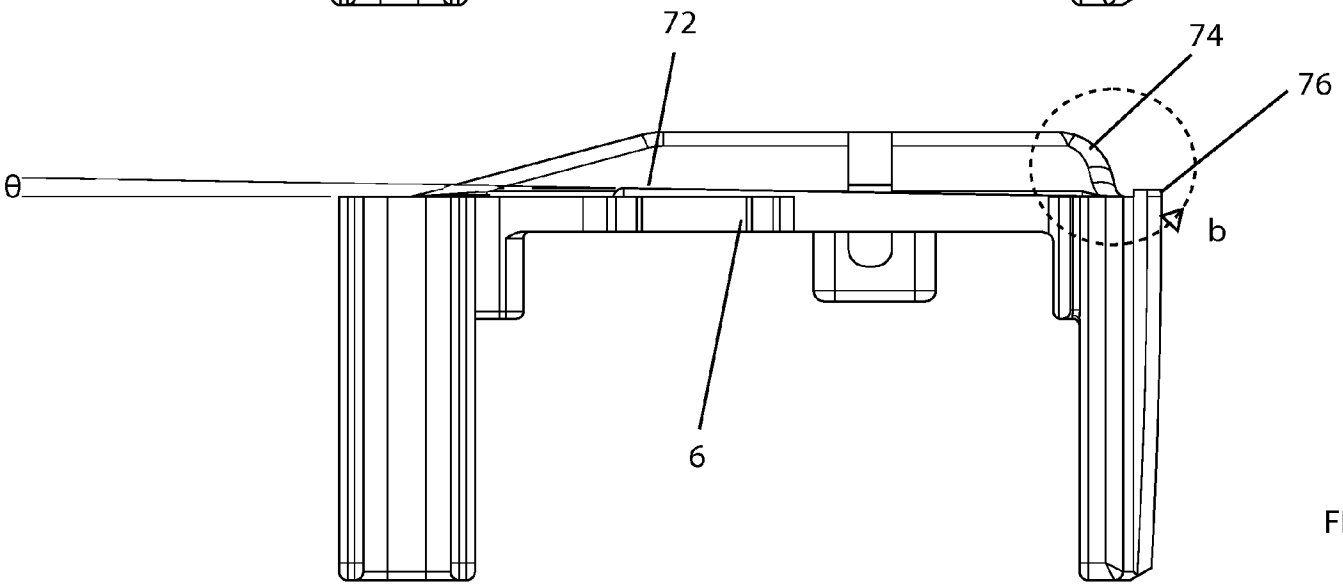
FIG. 10 is a perspective view of the follower of FIG. 8.
Figure 11:
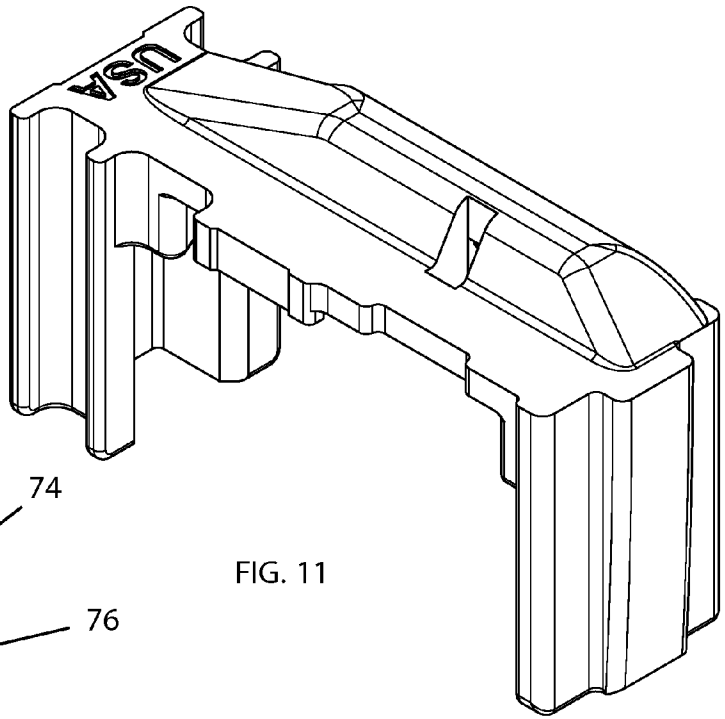
FIG. 11 is a side elevation of the follower of FIG. 7.

The improved follower departs from the prior art in the radical downward extension of the front 2 and rear 4 sides, shown in FIGS. 1, 2, and 5. The extended sides 2, 4 lessen the contortion of the follower in relation to the spring and magazine casing as the follower moves within the magazine during loading and unloading of ammunition. This is particularly important, as larger capacity magazines tend to curve slightly, forcing the follower to traverse a bend. Sides 2, 4 are also machined to fit inside the grooves of a magazine, particularly side 2 with trenches 10, 12. Side 4 is manufactured with a projection that corresponds to the magazine wall. As shown in FIG. 6, the floor 6 is also manufactured with spring retention walls 24, 26, to keep the follower centered on the follower spring within the magazine. The combination of these features provides stability to the follower and creates three mechanisms for self-correction in the event the follower misaligns.

Figure 4:
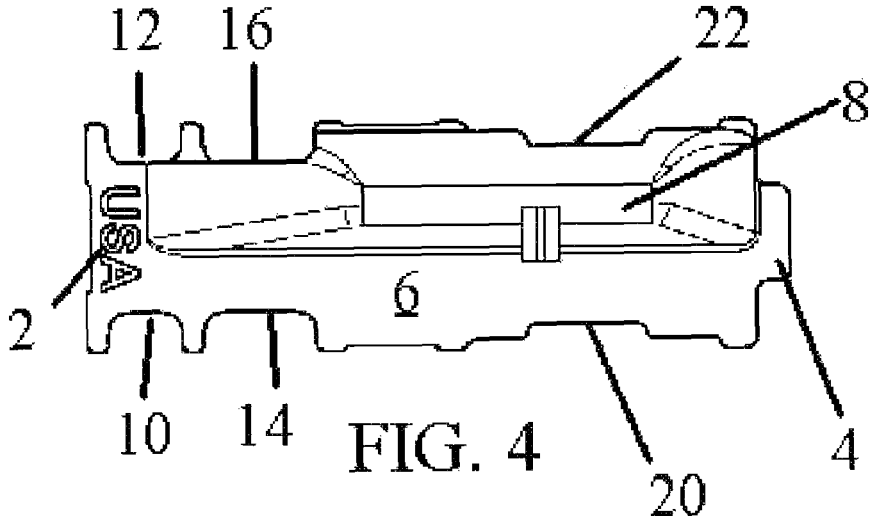
FIG. 4 is a top plan view of the follower of FIG. 1.

Another preferred feature of followers is the fashioning of them in a manner to allow easier assembly of the magazine. As shown in FIG. 4, trenches 10, 12, grooves 14, 16, 20, 22, and end 4 are all fashioned to insert around projections in the floor of the magazine, particularly those for securing the floor plate, while not allowing the follower to escape through the feed end of said magazine. These grooves 14, 16, 20, 22 may be fashioned in any location on the follower, dependent on the magazine construction.

In a preferred embodiment, shown in FIGS. 8, 10, 12 and 14, additional features are added to increase reliability. The original embodiment is shown in FIGS. 7, 9, 11 and 13 for comparison. A slight ramp 72 is raised on floor 6, right to left in FIGS. 8, 10, 12 and 14. This subtle ramp mimics round stack geometry and shifts the force distribution on the last two rounds in the magazine so that more force is placed on the rounds' shoulder areas (either the point where the jacket terminates or the point where the jacket decreased circumference as it encompasses the actual bullet, depending on round manufacture). This lessens the chance of misfeed of the second to last round. Ideally, this ramp should have an angle of incidence θ less than a degree, and a very slight angle, even less than one tenth of a degree, is effective and preferred. The length of the ramp 72 relative to the floor 6 of the follower should be sufficient to provide support to the bottom rounds of ammunition in such a manner to contribute to round stability. The length should be sufficient to support the round's center of gravity, typically at least 40% of the distance from the hind end of the follower to the fore. Ideally, the ramp 72 should extend sufficiently to allow either the shoulder of the bottom round to rest on the ramp 72, in most cases this would be 50% to 75% of the length of the floor of the follower. It is also conceivable that the ramp 72 may extend the entire length of the floor 6.

In another preferred embodiment, the hind area 74 of the spacer 8 is also designed to lessen misfeeding. Instead of a straight slope, the spacer first tapers as a convex function, then switches to a concave function 78 (FIG. 14) as the edge of the spacer 8 approaches the floor 6. The revised shape increases the force the bolt must exert on the round to actually cause a misfeed, thereby reducing its chance of occurrence.

Figure 12:
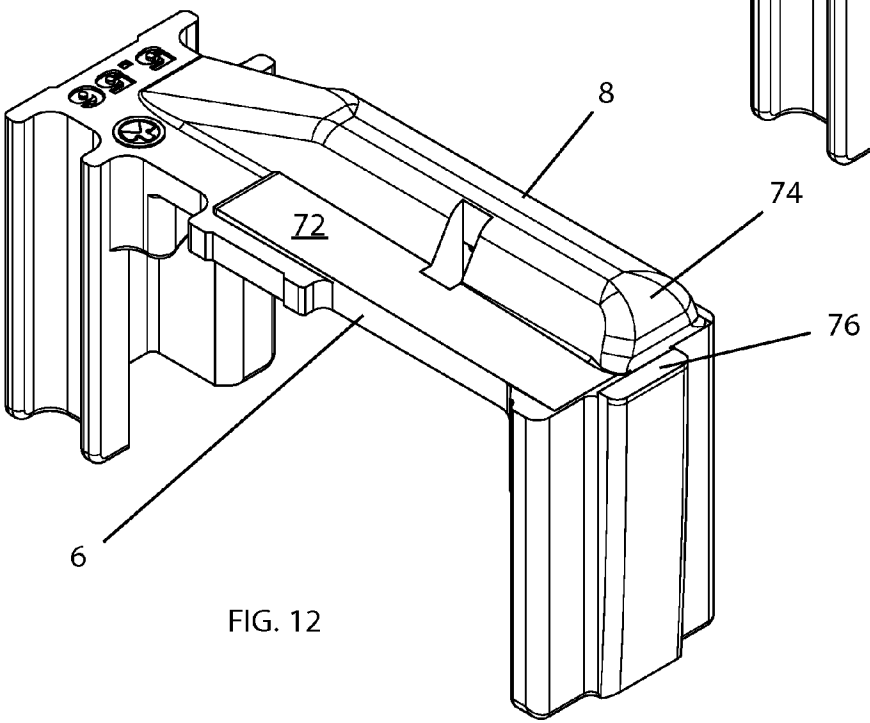
FIG. 12 is a side elevation view of the follower of FIG. 8.
Figure 13:
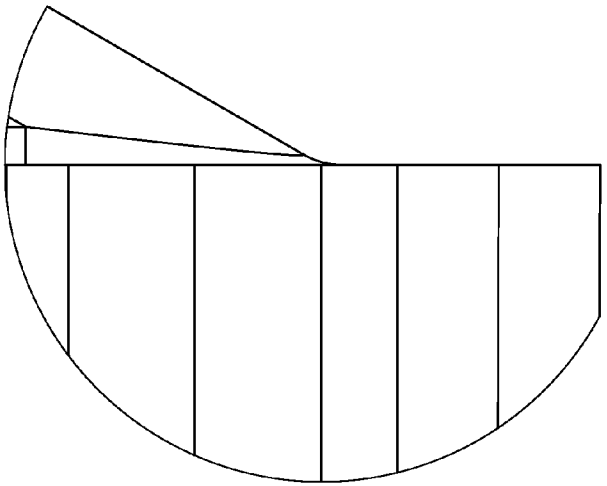
FIG. 13 is a close-up view of the follower of FIG. 7, taken in circle a of FIG. 9.
Figure 14:
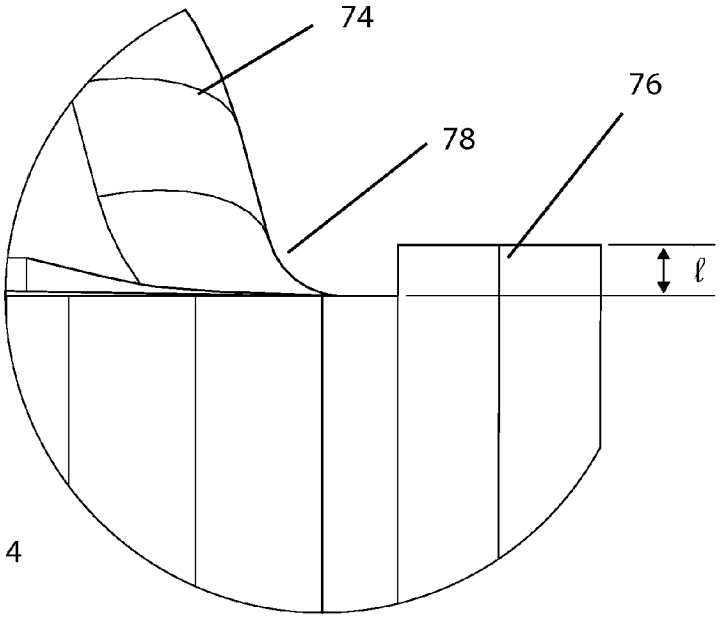
FIG. 14 is a close-up view of the follower of FIG. 8, taken in circle b of FIG. 10.

Another preferred embodiment of the follower features a stop shelf 76 at the very rear of the follower, best seen in FIGS. 12 and 14. Stop shelf 76 is a small section of the floor which is raised a length l (in the preferred embodiment l is approximately 0.0030 in.) in relation to the remainder of the floor 6. Stop shelf 76 facilitates interaction with a bolt stop after the last round is fired.

Although the present invention has been described with reference to preferred embodiments, numerous modifications and variations can be made and still the result will come within the scope of the invention. Each feature listed in this specification as may be used individually or in concert with other preferred features to manufacture a follower that is improved over the prior art. No limitation with respect to the specific embodiments disclosed herein is intended or should be inferred.

What is claimed is:

1. A follower for an ammunition magazine comprising:

a. an oblong follower floor, b. an ammunition spacer, defining a top of the floor, positioned on one extreme side of the top of the floor and extending parallel to a length of the floor;

c. a ramp located on the top of the floor and adjacent the spacer, said ramp originating from a hind side of the follower with an angle of incidence, θ;

d. a spring nub projecting downward from the floor on a bottom of the floor;

e. at least one spring retention wall on the bottom of the floor;

f. a front end extending downward beyond a level defined by the spring nub; and g. a hind end extending downward beyond a level defined by the spring nub.

2. The follower of claim 1, the spacer tapering towards a hind end of the follower from a first given point on the spacer initially according to a convex function and switching to a concave function at a second given point, located between said first given point and the hind end of the follower, on the spacer.

3. The follower of claim 2, the ramp extending towards a fore side of the follower for at least 40% of a length of the follower.

4. The follower of claim 3, θ having a measurement under 1°.

5. The follower of claim 4 further comprising a bolt stop shelf projecting upwards from a hind side of the follower.

6. The follower of claim 5, the bolt stop shelf being an elevated ledge, extending no more than 0.01 in. from a level of the floor.

7. The follower of claim 3 further comprising a bolt stop shelf projecting upwards from a hind side of the follower.

8. The follower of claim 7, the bolt stop shelf being an elevated ledge, extending no more than 0.01 in. from a level of the floor.

9. The follower of claim 2 further comprising a bolt stop shelf projecting upwards from a hind side of the follower.

10. The follower of claim 9, the bolt stop shelf being an elevated ledge, extending no more than 0.01 in. from a level of the floor.

11. The follower of claim 1, the ramp extending towards a fore side of the follower for at least 40% of a length of the follower.

12. The follower of claim 11, θ having a measurement less than 1°.

13. The follower of claim 12 further comprising a bolt stop shelf projecting upwards from a hind side of the follower.

14. The follower of claim 13, the bolt stop shelf being an elevated ledge, extending no more than 0.01 in. from a level of the floor.

15. The follower of claim 11 further comprising a bolt stop shelf projecting upwards from a hind side of the follower.

16. The follower of claim 15, the bolt stop shelf being an elevated ledge, extending no more than 0.01 in. from a level of the floor.

17. The follower of claim 1 further comprising a bolt stop shelf projecting upwards from a hind side of the follower.

18. The follower of claim 17, the bolt stop shelf being an elevated ledge, extending no more than 0.01 in. from a level of the floor.

* * * * *